US008567353B2

(12) United States Patent
DeFilippis et al.

(10) Patent No.: US 8,567,353 B2
(45) Date of Patent: Oct. 29, 2013

(54) ASSEMBLIES AND METHODS FOR SECURING A RISER BRACE

(75) Inventors: Michael S. DeFilippis, Wilmington, NC (US); Bruce J. Lentner, Wilmington, NC (US)

(73) Assignee: GE-Hitachi Nuclear Energy Americas LLC, Wilmington, NC (US)

( * ) Notice: Subject to any disclaimer, the term of this patent is extended or adjusted under 35 U.S.C. 154(b) by 982 days.

(21) Appl. No.: 12/640,802

(22) Filed: Dec. 17, 2009

(65) Prior Publication Data

US 2011/0146597 A1 Jun. 23, 2011

(51) Int. Cl.
*F22B 37/06* (2006.01)

(52) U.S. Cl.
USPC ..... 122/511; 376/285

(58) Field of Classification Search
USPC ..... 122/511, 510; 248/68.1, 62, 73, 74.4; 110/324, 322, 325; 376/372, 461, 285, 376/260; 228/44.3
See application file for complete search history.

(56) References Cited

U.S. PATENT DOCUMENTS

| | | | | | |
|---|---|---|---|---|---|
| 4,753,197 | A * | 6/1988 | Mullinax | ..... | 122/510 |
| 5,136,985 | A * | 8/1992 | Krowech | ..... | 122/510 |
| 6,108,391 | A * | 8/2000 | Deaver et al. | ..... | 376/262 |
| 6,647,083 | B1 * | 11/2003 | Jensen | ..... | 376/286 |
| 7,185,798 | B2 * | 3/2007 | Butler | ..... | 228/44.5 |
| 8,142,145 | B2 * | 3/2012 | Thut | ..... | 415/200 |
| 8,170,174 | B1 * | 5/2012 | Lentner et al. | ..... | 376/372 |
| 2005/0247754 | A1 * | 11/2005 | Butler | ..... | 228/44.5 |
| 2007/0189434 | A1 * | 8/2007 | Jensen | ..... | 376/260 |
| 2010/0316180 | A1 * | 12/2010 | Lentner et al. | ..... | 376/260 |
| 2012/0155598 | A1 * | 6/2012 | Lentner et al. | ..... | 376/392 |

* cited by examiner

*Primary Examiner* — Gregory A Wilson
(74) *Attorney, Agent, or Firm* — Parks IP Law LLC; Stephen J. Terrell

(57) ABSTRACT

An assembly for securing a riser brace to a riser pipe includes brackets configured to engage a yoke of the riser brace and clamp bands that are configured to extend around the riser pipe and connect to the brackets. The assembly also includes a connection that connects the assembly as a unit and is configured to adjust the tightness of the assembly around the riser pipe and riser brace.

20 Claims, 4 Drawing Sheets

ASSEMBLIES AND METHODS FOR SECURING A RISER BRACE

TECHNICAL FIELD

The subject matter disclosed herein relates generally to boiling water reactors and more specifically to systems and methods for securing a riser brace to a riser pipe in a boiling water reactor.

BACKGROUND

Boiling water reactors typically include a coolant recirculation system providing forced convection flow through the core. A portion of the water flowing through the downcomer annulus is withdrawn from the reactor vessel via a recirculation water outlet and is fed under pressure into a plurality of jet pump assemblies distributed about the core shroud within the downcomer annulus. The jet pump assemblies produce a forced convection flow through the core, providing the required reactor core water flow.

The riser pipe of a jet pump assembly is supported and stabilized within the reactor vessel by a riser brace attached to the riser pipe and to an attachment wall, the attachment wall typically being the reactor vessel wall. The riser brace provides lateral and radial support to the riser pipe. In addition, the riser brace is designed to accommodate the differential thermal expansion resulting from reactor start-up and heat-up, and to accommodate the flow-induced vibration incumbent in the reactor water circulation system due to reactor recirculation pumps.

Commonly, the riser brace is attached to the riser pipe and to the attachment wall by being welded to the riser pipe and to the attachment wall. The riser brace is normally attached to the riser pipe via a weld. However, cracks have been known to develop in these welds. Also, intergranular stress corrosion cracking (IGSCC) resulting from corrosion, radiation, and/or stress occurs in the welds between the riser brace and the riser pipe. Cracks can grow in size and reach critical sizes for mechanical fatigue crack to the detriment of the jet pump assembly.

Accordingly, there is a need for reinforcing the weld between a riser pipe and a riser brace of a jet pump assembly, including mitigating or repairing a cracked weld to maintain structural integrity of the jet pump assembly and to avoid excessive vibration of the riser pipe or brace. There is an additional need for redundant structural support to the weld between a riser pipe and riser brace. Previously proposed designs are complicated, requiring the inlet mixer to be removed. Previous designs must also be extremely accurate to fit correctly and must be machined in the field for each particular application.

SUMMARY

The various embodiments overcome the shortcomings of the prior art by providing an apparatus and method that mechanically reinforces the weld between a riser pipe and riser braces in boiling water reactors. The installation of the system is simple and allows for minute adjustments and error correction without having to machine parts. It also allows for installation without inlet mixer removal. Cost cutting aspects are found in the absence of a need for specific machining and particular training.

According to an exemplary embodiment, an assembly for securing a riser brace to a riser pipe includes brackets configured to engage a yoke of the riser brace and clamp bands that are configured to extend around the riser pipe and connect to the brackets. The assembly also includes a connection that connects the assembly as a unit and is configured to adjust the tightness of the assembly around the riser pipe and riser brace.

The foregoing has broadly outlined some of the aspects and features of the various embodiments, which should be construed to be merely illustrative of various potential applications. Other beneficial results can be obtained by applying the disclosed information in a different manner or by combining various aspects of the disclosed embodiments. Other aspects and a more comprehensive understanding may be obtained by referring to the detailed description of the exemplary embodiments taken in conjunction with the accompanying drawings, in addition to the scope defined by the claims.

DETAILED DESCRIPTION OF THE DRAWINGS

DETAILED DESCRIPTION

As required, detailed embodiments are disclosed herein. It must be understood that the disclosed embodiments are merely exemplary of various and alternative forms. As used herein, the word "exemplary" is used expansively to refer to embodiments that serve as illustrations, specimens, models, or patterns. The figures are not necessarily to scale and some features may be exaggerated or minimized to show details of particular components. In other instances, well-known components, systems, materials, or methods that are know to those having ordinary skill in the art have not been described in detail in order to avoid obscuring the present disclosure. Therefore, specific structural and functional details disclosed herein are not to be interpreted as limiting, but merely as a basis for the claims and as a representative basis for teaching one skilled in the art.

Figure 1:
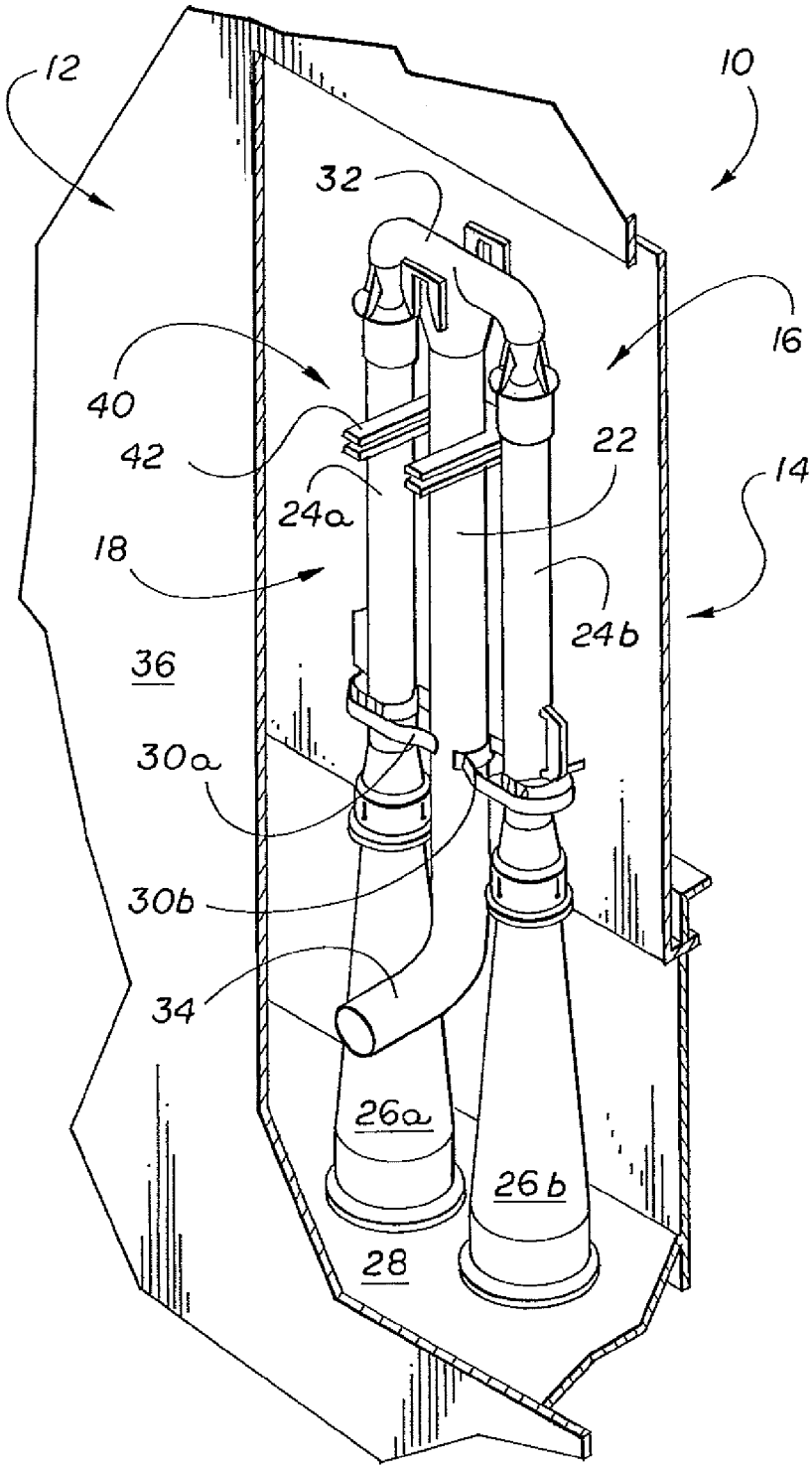
FIG. 1 is a partial perspective view of a boiling water reactor/reactor pressure vessel, according to an exemplary embodiment.

A boiling water reactor 10 shown in FIG. 1 includes a reactor pressure vessel 12 and a core shroud 14 disposed within the reactor pressure vessel 12. An annular region 16 (downcomer annulus) is the space between the core shroud 14 and the reactor pressure vessel 12. A jet pump assembly 18 of the boiling water reactor 10 is disposed in the annular region 16.

The jet pump assembly 18 includes a riser pipe 22 and inlet mixers 24*a*, 24*b*, each which extends substantially vertically in the annular region 16. The inlet mixers 24*a*, 24*b* are positioned on opposite sides of the riser pipe 22. Lateral support for the inlet mixers 24*a*, 24*b* is provided by restrainer supports 30*a*, 30*b* respectively attached between the inlet mixers 24*a*, 24*b* and the riser pipe 22.

A transition piece 32 connects the upper end of the riser pipe 22 and the upper ends of the inlet mixers 24*a*, 24*b*. The lower end of the riser pipe 22 includes an elbow 34 that curves toward and extends through the wall 36 of reactor pressure vessel 12 to a recirculation inlet nozzle (not shown) outside of the wall 36. The lower ends of the inlet mixers 24*a*, 24*b* include diffusers 26*a*, 26*b* that are mounted over holes in a pump deck 28. The pump deck 28 connects a bottom portion of the core shroud 14 with the reactor pressure vessel 12.

Figure 2:
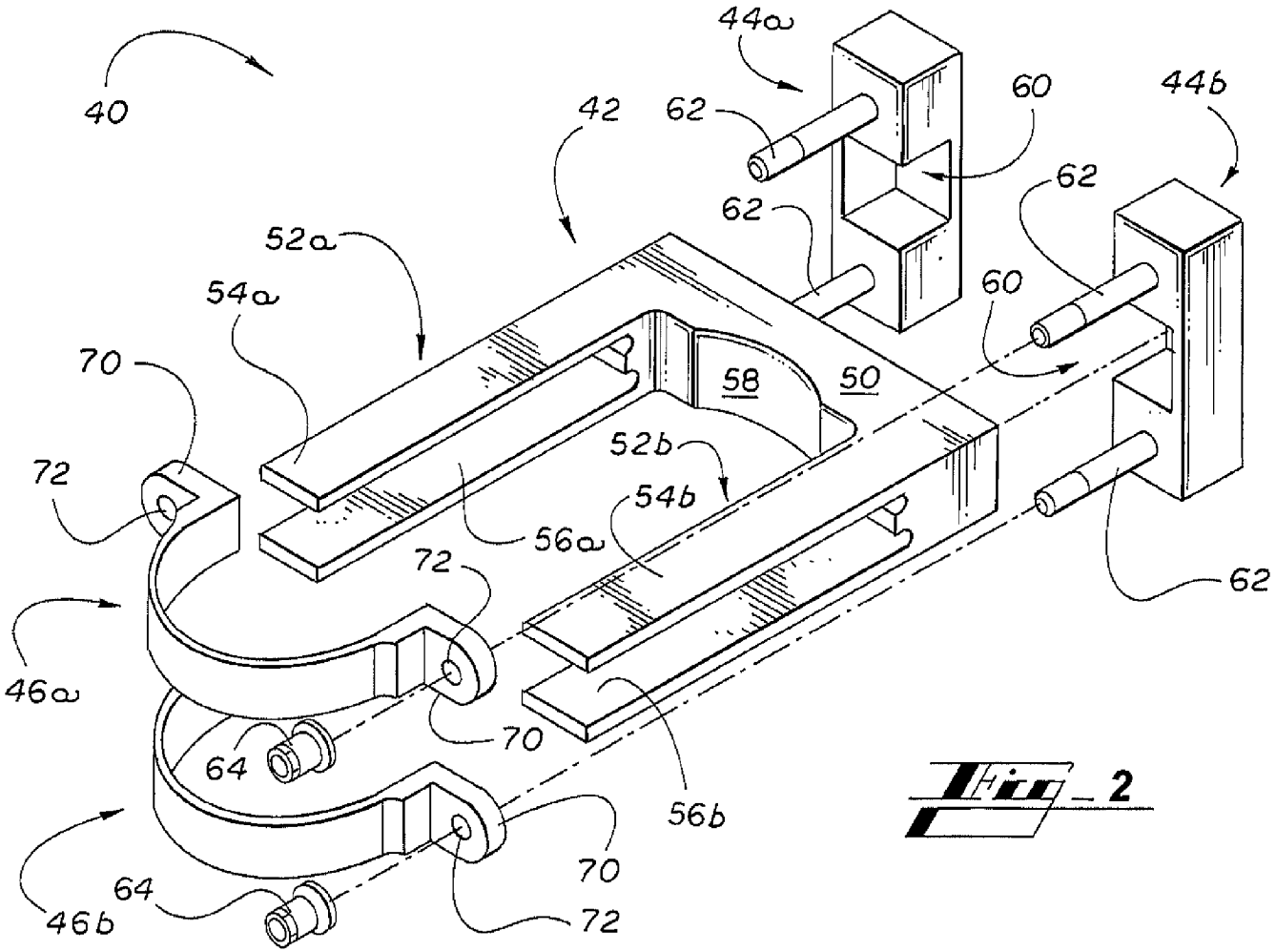
FIG. 2 is an exploded perspective view of a riser brace assembly.
Figure 3:
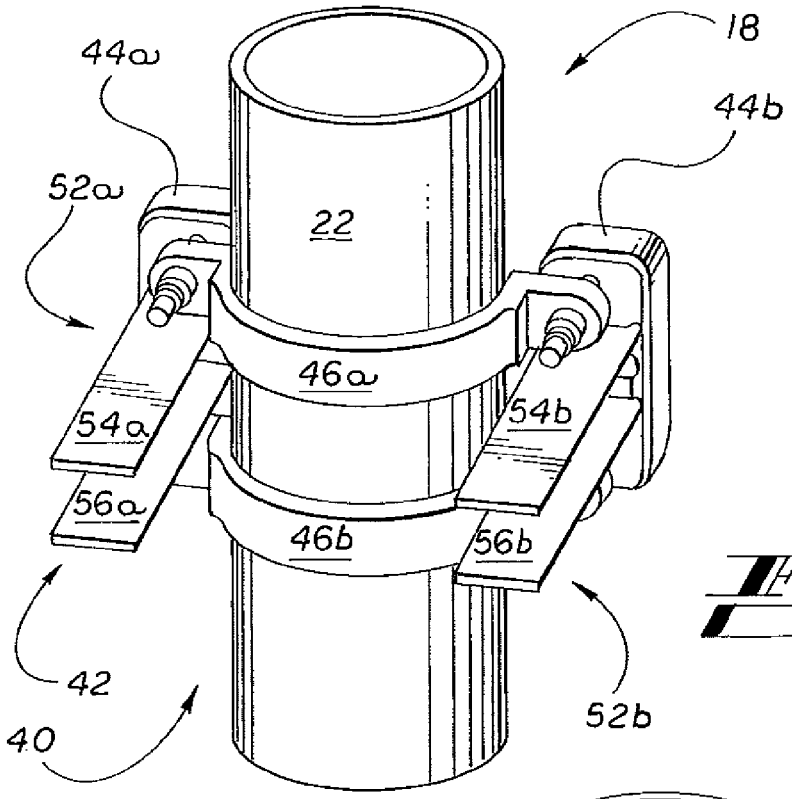
FIGS. 3 and 4 are perspective views of the riser brace assembly of FIG. 2.
Figure 4:
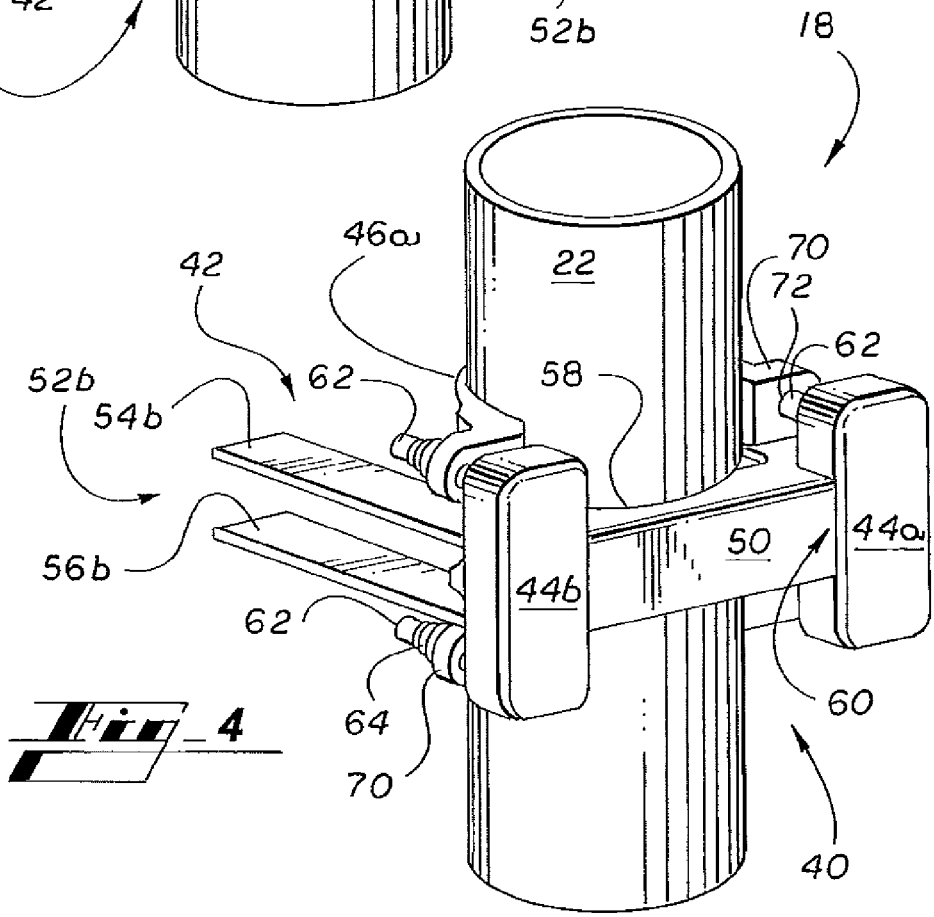

The riser pipe 22 is supported and stabilized within the annular region 16 by a riser brace assembly 40 and a riser brace 42. Referring to FIG. 2, the riser brace assembly 40 includes brackets 44 and clamp bands 46 that are configured to secure the riser brace 42 to the riser pipe 22. The riser brace 42 has a generally U-shaped configuration comprising a yoke 50 and side members 52*a*, 52*b* extending in parallel from opposite ends of the yoke 50. Each side member 52*a*, 52*b* includes an upper leg 54*a*, 54*b* and a lower leg 56*a*, 56*b*. The distance L between the side members 52*a*, 52*b* is greater than the diameter D of the riser pipe 22 such that the riser pipe 22 can be received between the side members 52*a*, 52*b* and abut against an inner surface 58 of the yoke 50. The inner surface 58 has a concave shape that is complementary to the convex shape of the riser pipe 22.

The brackets 44*a*, 44*b* are configured to slip onto or around the riser brace 42. Each bracket 44 includes a recess 60 that is configured to receive a corner of the yoke 50 and separates upper and lower portions of the bracket 44. The illustrated brackets 44 each include studs 62 and nuts 64 that facilitate securing the clamp bands 46*a*, 46*b* to the brackets 44*a*, 44*b* and tightening the clamp bands 46 and brackets 44 around the riser brace 42 and riser pipe 22. In alternative embodiments, a connection between a bracket and a clamp band can be made with other mechanical fasteners, welds, mechanical connections, hooks, clips, combinations thereof, and the like. Brackets and clamp bands, or portions of each, can be integrally formed pieces. In alternative embodiments, an assembly of brackets and clamp bands can be tightened around the riser pipe and riser brace using a worm gear and the like. In general, one or more connections that connect the assembly as a unit are configured to adjust the tightness of the assembly around the riser pipe and riser brace.

Recess 60 maintains the position of the bracket 44 at the corner of the yoke 50. In alternative embodiments, the bracket has a C-shaped cross-section such that the recess is configured to receive an end of the yoke 50 and can be adjustably positioned along the length of the yoke 50.

The clamp bands 46*a*, 46*b* are shaped to be complementary to the convex curvature of the riser pipe 22 and include flanges 70 with apertures 72 that are configured to receive the studs 62. The clamp bands 46*a*, 46*b* are sufficiently flexible to be used with riser pipes of different diameters.

The riser brace 42 is welded to the riser pipe 22 and the wall 36. The brackets 44*a*, 44*b* and clamp bands 46*a*, 46*b* or the riser brace assembly 40 are installed to support the welds. In alternative embodiments, the riser brace 42 is welded to the wall 36 and the brackets 44*a*, 44*b* and clamp bands 46*a*, 46*b* secure the riser brace 42 to the riser pipe 22 without the need for welds. One advantage of the riser brace assembly 40 is that it is configured to be installed without removing the inlet mixers 24*a*, 24*b*. Exemplary methods of installing the riser brace assembly 40 to support the riser pipe 22 and riser brace 42 are now described in further detail.

Figure 5:
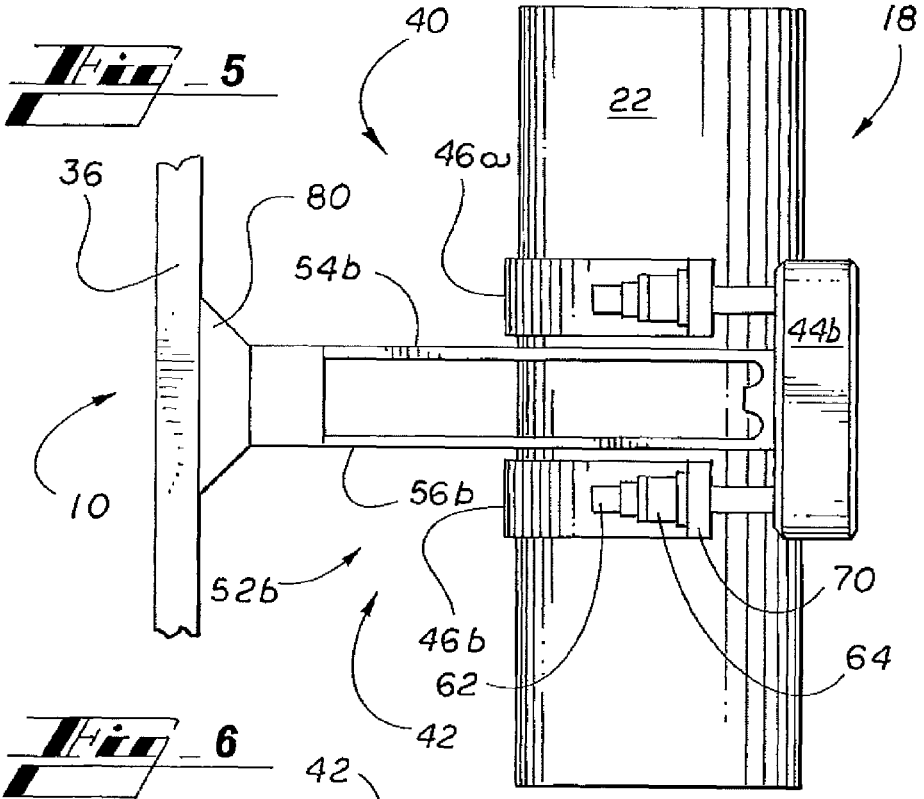
FIG. 5 is an elevational view of the riser brace assembly of FIG. 2.
Figure 6:
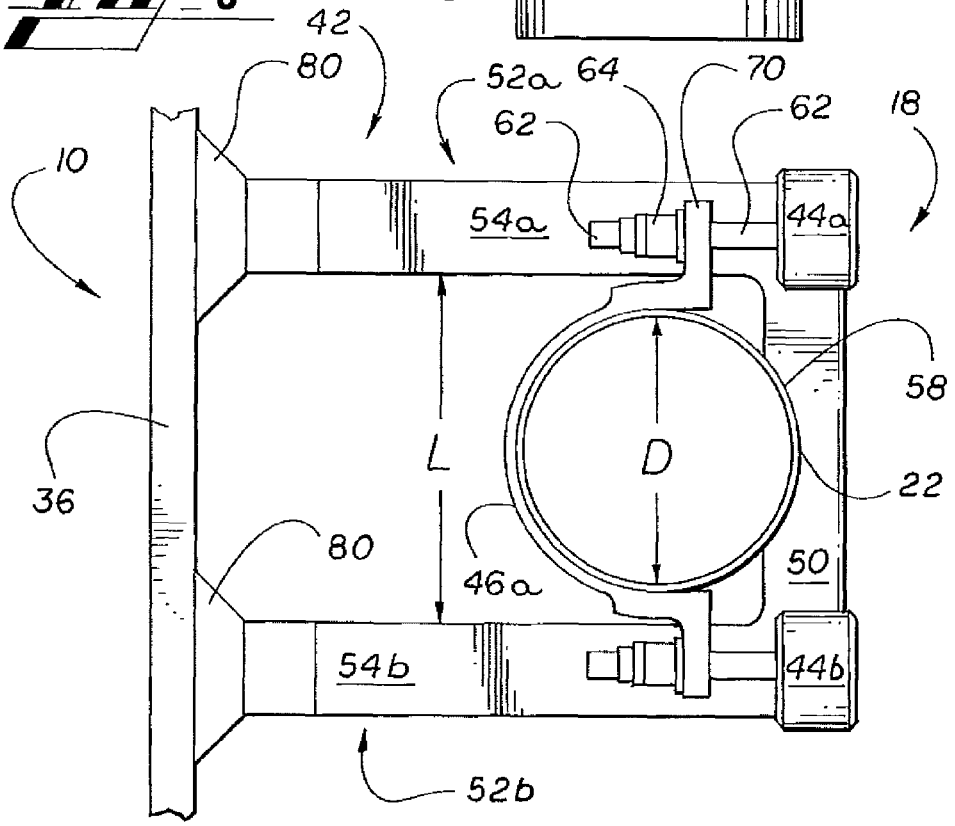
FIG. 6 is a plan view of the riser brace assembly of FIG. 2.

As shown in FIGS. 1-6, the riser brace 42 is positioned to saddle the riser pipe 22 with the inner surface 58 of the yoke 50 against the riser pipe 22 and the side members extending toward the wall 36. Referring to FIGS. 5 and 6, the side members 52*a*, 52*b* are secured to the wall 36. The ends of the side members 52*a*, 52*b* are welded to pads 80 that are in turn welded to the interior surface of the wall 36. The yoke 50 is welded to the riser pipe 22 at an edge of the inner surface 58.

The brackets 44*a*, 44*b* attach to the shroud side of the yoke 50 with the yoke 50 being received in the recesses 60 and the studs 62 extending toward the wall 36. The clamp bands 46*a*, 46*b* are placed against the attachment wall 36 side of the riser pipe 22 with a stud 62 of each of the brackets 44*a*, 44*b* received in the apertures 72. The nuts 64 attach to the studs 62 to secure the clamp bands 46*a*, 46*b* to the brackets 44*a*, 44*b*. The nuts 64 are tightened to frictionally secure the riser brace 42 against the riser pipe 22. Tightening the nuts 64 pulls the clamp bands 46*a*, 46*b* and the brackets 44*a*, 44*b* together, which causes the brackets 44*a*, 44*b* to force the riser brace 42 against the riser pipe 22.

The written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An assembly for securing a riser brace to a riser pipe, the riser brace including a yoke and side members, the riser brace saddling the riser pipe with an inner surface of the yoke against the riser pipe and the riser pipe between the side members, the assembly comprising:

a first bracket and a second bracket, each bracket including an upper portion, a lower portion, and a recess between the upper portion and the lower portion, the recess being configured to engage the yoke;

a first clamp band and a second clamp band, each clamp band being configured to extend around the riser pipe and connect the brackets, the first clamp band being configured to connect the upper portions of the first bracket and the second bracket, the second clamp band being configured to connect the lower portions of the first bracket and the second bracket; and at least one connection that connects the assembly as a unit, the connection being adjustable to adjust the tightness of the assembly around the riser pipe.

2. The assembly of claim 1, wherein the connection includes a stud extending from at least one of the brackets.

3. The assembly of claim 2, wherein the recess is configured to receive a corner of the yoke.

4. The assembly of claim 2, wherein the recess is configured such that the position of the associated bracket is adjustable along the length of the yoke.

5. The assembly of claim 2, wherein each clamp band is semi-circular.

6. The assembly of claim 2, wherein each clamp band is flexible so as to fit various riser pipe diameters.

7. The assembly of claim 2, wherein the clamp bands are configured to contact one side of the riser pipe and the brackets are configured to maintain contact between the riser brace and an opposite side of the riser pipe.

8. The assembly of claim 1, the recess comprising a top surface and a bottom surface that are configured to contact a top surface and a bottom surface of the yolk.

9. The assembly of claim 8, the recess comprising a first vertical surface extending between the top surface and the bottom surface.

10. The assembly of claim 9, the recess comprising a second vertical surface, the second vertical surface extending between the top surface and the bottom surface, the first vertical surface and the second vertical surface being substantially perpendicular to one another.

11. The assembly of claim 1, wherein each bracket has a C-shaped cross section.

12. A method for securing a riser brace to a riser pipe, the riser brace including a yoke and side members, the riser brace saddling the riser pipe with an inner surface of the yoke against the riser pipe and the riser pipe between the side members, the method comprising:

attaching a first bracket and a second bracket to the yoke of the riser brace such that:

the yoke is received in a recess of each bracket;

an upper portion of each bracket is positioned above the yoke; and a lower portion of each bracket is positioned below the yoke;

connecting a first clamp band to the upper portion of each of the first bracket and the second bracket; and connecting a second clamp band to the lower portion of each of the first bracket and the second bracket.

13. The method of claim 12, further comprising tightening the assembly of brackets and clamp bands to secure the riser brace against the riser pipe.

14. An assembly for securing a riser brace to a riser pipe, the riser brace including a yoke and side members, the riser brace saddling the riser pipe with an inner surface of the yoke against the riser pipe and the riser pipe between the side members, the assembly comprising:

a first bracket and a second bracket, each bracket comprising:

an upper portion;

a lower portion;

a recess between the upper portion and the lower portion, the recess being configured to engage the yoke; and a stud extending from each of the upper portion and the lower portion;

a first clamp band and a second clamp band, each clamp band being configured to extend around the riser pipe between the first bracket and the second bracket, each clamp band comprising a first aperture configured to receive a stud of the first bracket and a second aperture configured to receive a stud of the second bracket; and for each stud, a mechanical fastener that adjustably attaches to the stud is configured to secure a clamp band to a respective bracket.

15. The assembly of claim 14, wherein the recess is configured to receive a corner of the yoke.

16. The assembly of claim 14, wherein the recess is configured such that the position of the associated bracket is adjustable along the length of the yoke.

17. The assembly of claim 14, wherein each clamp band is semi-circular.

18. The assembly of claim 14, wherein each clamp band includes flanges at opposed ends, the first aperture and the second aperture being formed in the flanges.

19. The assembly of claim 14, wherein each clamp band is flexible so as to fit various riser pipe diameters.

20. The assembly of claim 14, wherein the clamp bands are configured to contact one side of the riser pipe and the brackets are configured to maintain contact between the riser brace and an opposite side of the riser pipe.

* * * * *